United States Patent [19]

Tagirov et al.

[11] 4,047,569

[45] Sept. 13, 1977

[54] METHOD OF SUCCESSIVELY OPENING-OUT AND TREATING PRODUCTIVE FORMATIONS

[76] Inventors: Kurban Magomedovich Tagirov, ulitsa Lenina, 408a, kv. 25; Nikolai Rubenovich Akopian, ulitsa Sochinskaya, 64, both of Stavropol, U.S.S.R.

[21] Appl. No.: 659,745

[22] Filed: Feb. 20, 1976

[51] Int. Cl.[2] ..... E21B 43/26

[52] U.S. Cl. ..... 166/308; 166/222; 166/298

[58] Field of Search ..... 166/308, 222, 223, 100, 166/177, 298

[56] References Cited

U.S. PATENT DOCUMENTS

| | | | |
|---|---|---|---|
| 2,302,567 | 11/1942 | O'Neill | 166/298 X |
| 2,758,653 | 8/1956 | Desbrow | 166/308 X |
| 2,851,109 | 9/1958 | Spearow | 166/308 X |
| 3,058,521 | 10/1962 | Gilbert | 166/308 |
| 3,130,786 | 4/1964 | Brown et al. | 166/298 X |
| 3,224,506 | 12/1965 | Huitt et al. | 166/308 X |
| 3,393,736 | 7/1968 | Goodwin | 166/298 X |

*Primary Examiner*—Stephen I. Novosad
*Attorney, Agent, or Firm*—Lackenbach, Lilling & Siegel

[57] ABSTRACT

In the disclosed method of successively opening-out and treating formations, nozzles are firmly pressed against the casing walls in opposition to the selected area of forming a hydraulic fracture, each nozzle having a through passage of a diameter ensuring that at a constant specified flow rate of a fluid with an abrasive filler through the passage there will be built up a pressure sufficient for hydraulic fracturing of the formation. The abrasive-laden fluid is then pumped through the nozzles at the constant flow rate at a pressure sufficient for making a perforation in the casing wall, the pressure being not less than that required for hydraulic fracturing of the formation, until a perforation of a diameter substantially equal to that of the through passages of the nozzle is formed. With the perforation made, the rate of flow of the fluid with the abrasive filler, pumped through the nozzles, is varied to produce a constant pressure within the bed formation, not less than the pressure required for hydraulic fracturing of this formation.

1 Claim, 9 Drawing Figures

METHOD OF SUCCESSIVELY OPENING-OUT AND TREATING PRODUCTIVE FORMATIONS

The present invention relates to methods of successive opening-out and complex treating of productive formations and, more particularly, it relates to methods of hydraulic jetting of casings with subsequent hydraulic fracturing of a formation. The invention can be used to utmost advantage for hydraulic fracturing gas- and oil-bearing formations in multi-stratum fields or in a single thick stratum.

Furthermore, the disclosed method can be used for various treating operations, e.g. hydrochloric acid treatment, mud-acid treatment, methanol treatment, surfactant treatment etc.

The herein disclosed method enables several hydraulic fractures to be formed with a desired spacing therebetween in a single trip of the tubing into the wellbore, without using packers.

When developing multi-stratum fields or a thick stratum, e.g. oil or gas-bearing strata, it may be necessary to step up the productivity of either oil or gas.

This can be attained by a variety of methods.

According to one method, hydraulic fracturing of the bed is effected with a wellbore portion, having either the a thick stratum or multiple strata and the productivity whereof is to be increased, being left uncased, whereafter a fluid is pumped into the wellbore under a pressure required for hydraulic fracturing. As a result, one or several hydraulic features are formed in the least consolidated part of the formation.

Research has shown that when there are several bearing beds, each of them has characteristics different from those of the rest. Not every one of the beds would get the fracturing fluid, and not every one of the beds in a producing well would yield oil. Therefore, when multi-stratum fields are developed, and also when fields with thick strata where individual treatment is required, there is employed the technique of successively opening-out and treating the productive formations or portions of the thick stratum. The term portions of a thick stratum is in the present disclosure meant to denote the spacing between successive hydraulic fractures which are to be formed to step up the oil or gas yield of the thick stratum.

At successive hydraulic fracturing of a bed, fractures are formed either in preselected areas of a single thick stratum or in several strata through which a hole has been drilled. Logging charts and diagrams are usually used to select the areas where hydraulic fractures are to be formed.

According to one of the known methods of successive opening-out and hydraulic fracturing of a thick stratum the casing is perforated at the level of the bottommost area where hydraulic fractures are to be formed. This casing perforation can be made by several techniques, e.g. hydraulic jetting cumulative jetting, etc. With the perforations having been made in the casing, tubing with a packer is lowered into the well, and a fluid is pumped under pressure thereinto to form hydraulic fractures. Thereafter, the portion of the bed with the hydraulic features formed therein is packed with sand, the tubing with the packer is pulled out, and perforation of the casing at the next portion of the bed is performed. Then the tubing with the packer is run once again into the well, and hydraulic fracturing of this next portion of the bed is effected. The same sequence of operations is repeated at each selected portion of the bed.

According to another method, prior to perforation of the casing, a chalk solution or mud is pumped into the well. Then the tubing with a hydraulic jet perforator is run into the well, the perforator being positioned against the bottommost bed to be worketreated. As a result of perforation, the passages uniformly distributed in the bed, within a single plane are formed. Thereafter, the tubing with the perforator is pulled out, the tubing with the packer is run into the well and positioned above the perforated portion of the casing, and then hydraulic fracturing of the formation in the perforated area is performed. This done, the tubing with the packer is pulled out, the tubing with the perforator is run into the well once again, with the perforator placed against the next portion of the formation, and perforation is effected. Upon a predetermined number of hydraulic fractures having been made in the formation, the tubing is run down to the bottom hole, and the well is flushed. To remove the chalk solution from the formation and the chalk scale from the perforations, made in the casing, the well is treated with hydrochloric acid. Then the well is air-blasted, and its operation commences.

There is also known a method of successive hydraulic fracturing of a formation, performed in the well in the downward direction, with the uppermost portion of the formation being treated first, whereafter the hydraulic fracture is separated from the rest of the well by placing a packer below the fracture, and the next portion of the formation is fractured. This sequence of operations is repeated until a predetermined number of hydraulic fractures is formed.

According to still another known method a jet perforator is lowered into the well to a required depth, the perforator containing six charges accommodated in an aluminium housing. The casing is perforated in there opposite directions, so that the perforation passages at each side shall intersect at one point. Then, the tubing with the packer is run into the well, and hydraulic fracturing of the formation is performed. To make subsequent fractures, the previous one is insulated either with sand or by some other means, and the abovedescribed operations are repeated.

There is known yet another method of hydraulic fracturing of a formation, wherein there are cut V-shaped guiding grooves in the casing and formation situated in the area where a hydraulic fracture is to be made. This is done by lowering into the well a drill string with a cutting tool having cutters secured thereto. Under the pressure of the fluid pumped into the well the cutters are moved out, and the tool is rotated to cut through the casing and the formation. Then the drill string with the cutters is pulled out, the tubing with the packer is run into the well, and hydraulic fracturing is performed. The next hydraulic fracture is formed in the same manner, with the previous one having been temporarily isolated.

In each one of the above-described methods, at least three operations are to be successively performed to make a hydraulic feature, viz. perforating of the casing, hydraulic fracturing and temporarily isolating the fracture. In the case of multi-stratum fields and fields with thick strata known methods involve a great number of round trips of the tubing in the well, the number of such round trips increasing in proportion with the quantity of either the formations or of the portions of a thick stratum to be fractured. Besides, all the above-described methods are labor-consuming and possess poor directability, as far as making a fracture precisely in the specified area of a formation is concerned. On the other hand, in field production this very possibility of forming fractures in preselected areas determined by logging charts is of paramount importance.

There is also known a method of making perforations in a casing by hydraulic perforation at various depths, including running into the well of a hydraulic perforator incorporating jet nozzles resistant to abrasive wear, the perforator being fixed in the well bore and an abrasive-laden fluid being pumped under a pressure sufficient for making perforations in the casing walls. With the perforations made in the casing, the pressure of the fluid pumped through the jet nozzles is increased, whereby the nozzles are moved out to press against the casing wall. With the nozzles thus pressed against the casing wall, the pressure of the fluid pumped through the nozzles is increased to provide for hydraulic fracturing of the formation.

In this method perforations made in the casing wall are of an irregular arbitrary shape. Accordingly, during the hydraulic fracturing operation, the fluid filling the space beyond the casing flows back into the casing, which reduces the efficiency of the hydraulic fracturing, since the kinetic energy of the abrasive-laden fluid jets is not entirely spent to develop pressure for hydraulic fracturing of the formation.

Besides, said method involves additional operations to vary the pressure of the fluid pumped through the jet nozzle to the value required for hydraulic fracturing of the formation, after the perforations have been made in the casing.

It is an object of the present invention to overcome the above disadvantages.

It is another object of the present invention to increase the efficiency of the hydraulic fracturing method by pumping an abrasive-laden fluid through jet nozzles.

Yet another object of the present invention in to cut down the number of operations performed at hydraulic perforation and hydraulic fracturing of a formation.

Still another object of the present invention is to dispense with the packer during hydraulic fracturing of a formation.

It is a further object of the present invention to provide a method of successive opening and treating a productive formation with an abrasive laden fluid being pumped through jet nozzles, wherein the entire kinetic energy of the fluid jets should be spent to develop the hydraulic fracturing pressure within the formation.

These objects are attained, according to the present invention, by pressing the nozzles firmly against the casing walls opposite to the selected area of forming a hydraulic fracture, the nozzles having each a through passage of a diameter ensuring that at a specified constant flow rate of the abrasive-laden fluid pumped through the nozzle, a pressure is built up sufficient for hydraulic fracturing of the formation; then building up a pressure, at a constant rate of flow of the abrasive-laden fluid through the nozzles, to a value sufficient for making a perforation in the casing, but not less than the pressure required for hydraulic fracturing of the formation, until a perforation is made in the casing wall, of a diameter substantially equal to that of the through passage of the nozzles; upon the perforation having been made, varying the rate of flow of the abrasive-laden fluid through the nozzles to produce a substantially constant pressure within the formation, not less than that required for hydraulic fracturing of the formation.

The nozzles being pressed tight to the casing wall permits making perforations of a diameter substantially equal to that of the through passages of the nozzles, thereby transmitting practically the entire kinetic energy of the abrasive-laden fluid jets pumped through the nozzles to the formation, to effect hydraulic fracturing of the latter.

Furthermore, with the operations of making perforations in the casing wall and hydraulic fracturing of the formation being performed in a single process, there can be effected, in a single trip of the tools in the well successive openingout and treating of either multi-stratum productive several mineral fields, or successive portions of a single bed in thick stratum fields.

The invention will be further described in connection with an embodiment thereof, with reference being had to the accompanying drawings wherein.

Figure 3:
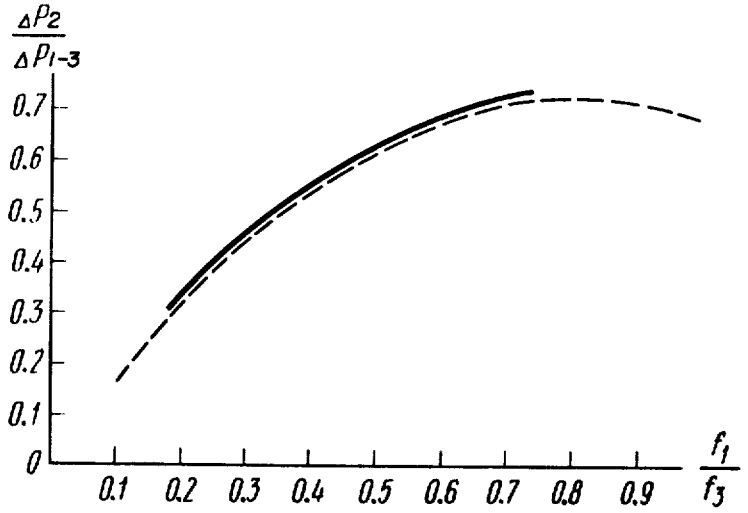
Figure 4:
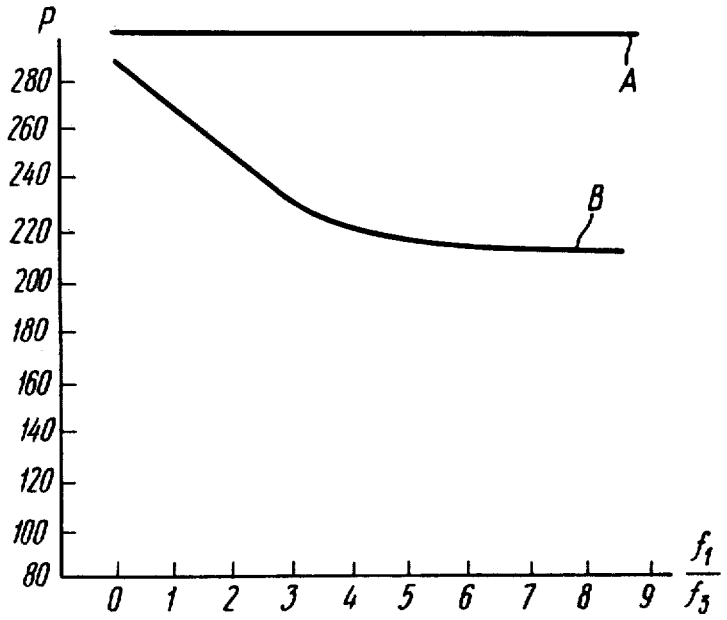
Figure 5:
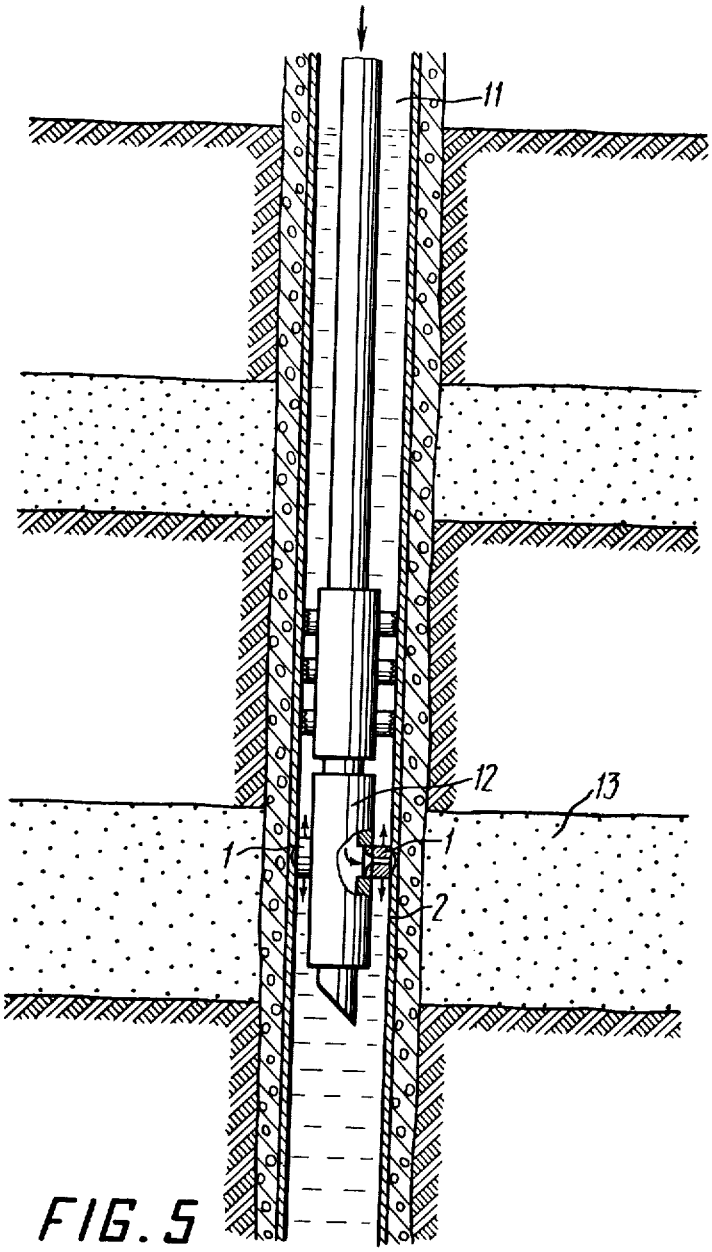
Figure 6:
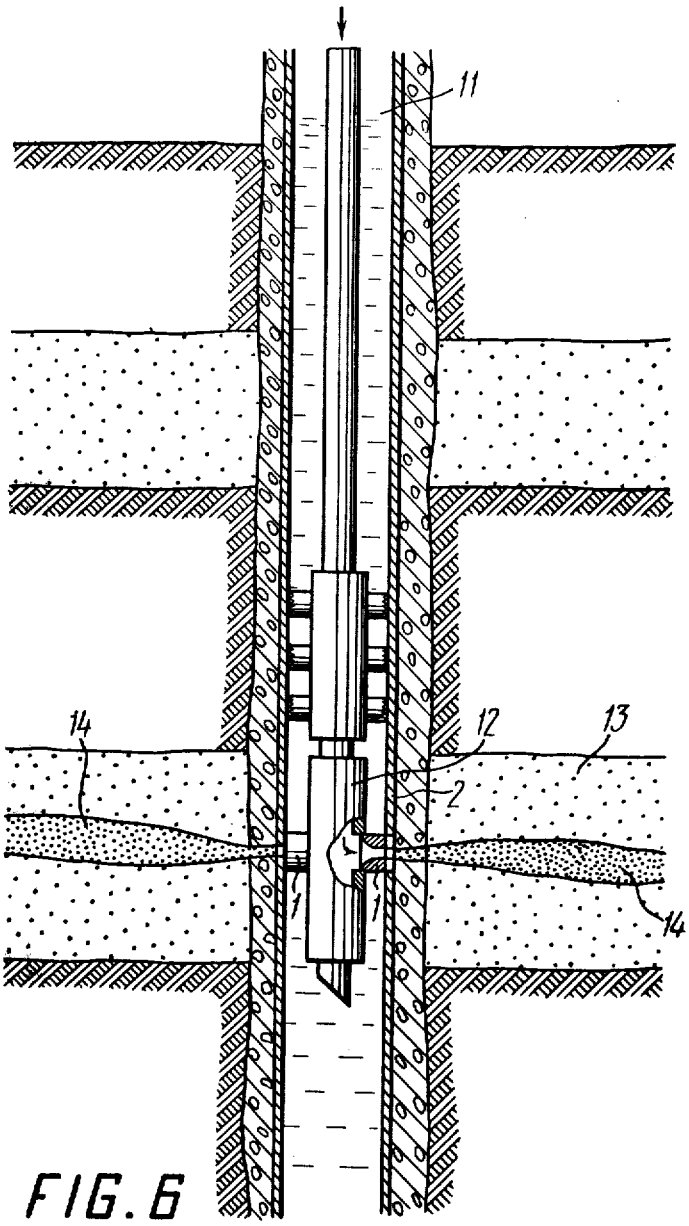
Figure 7:
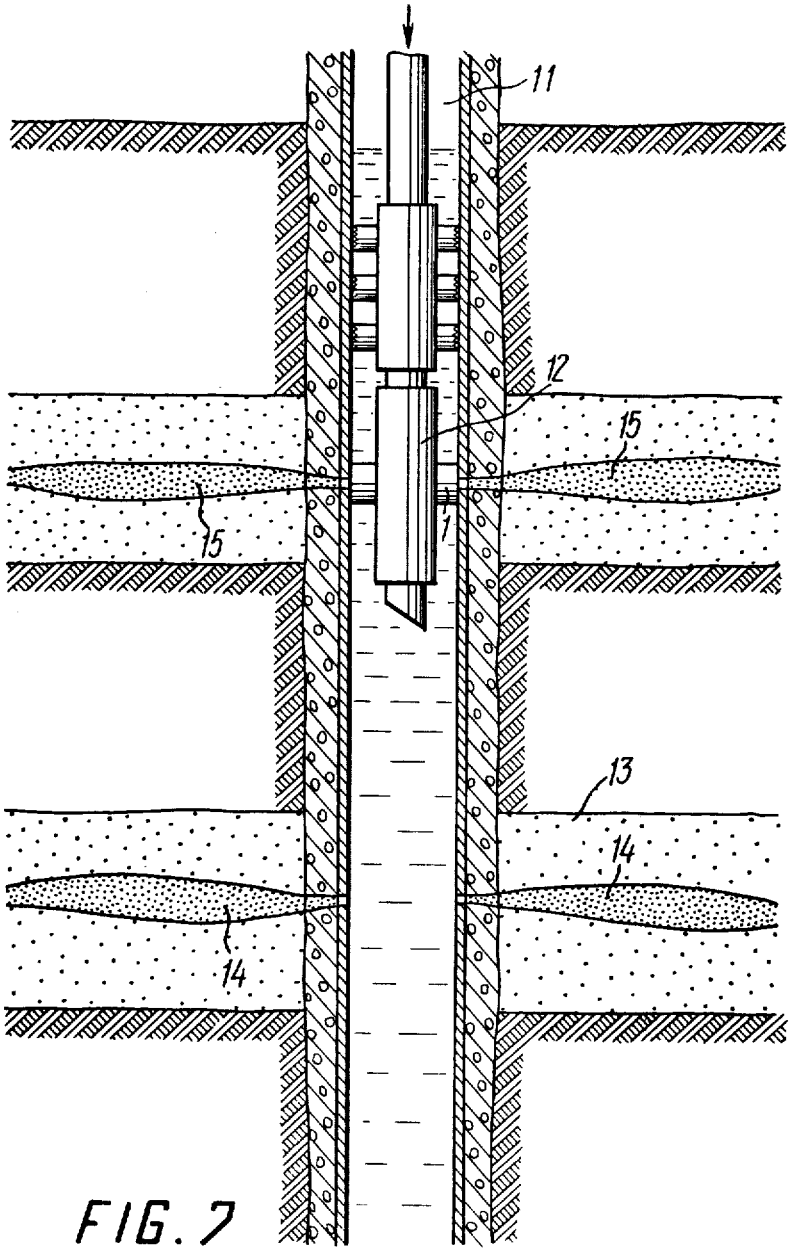
Figure 8:
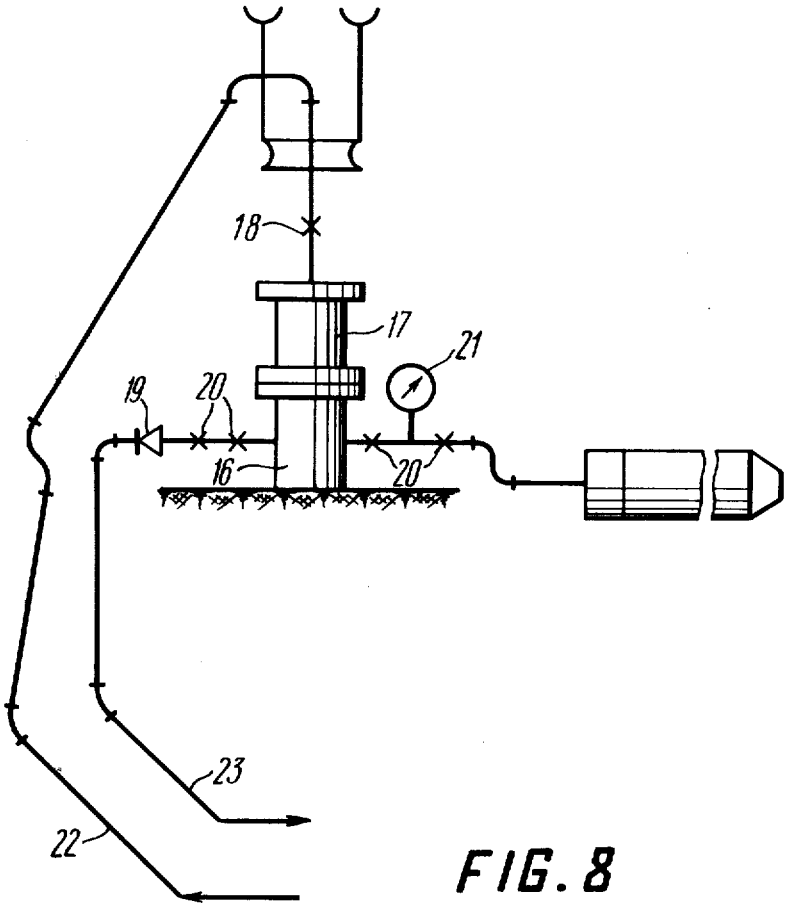
Figure 9:
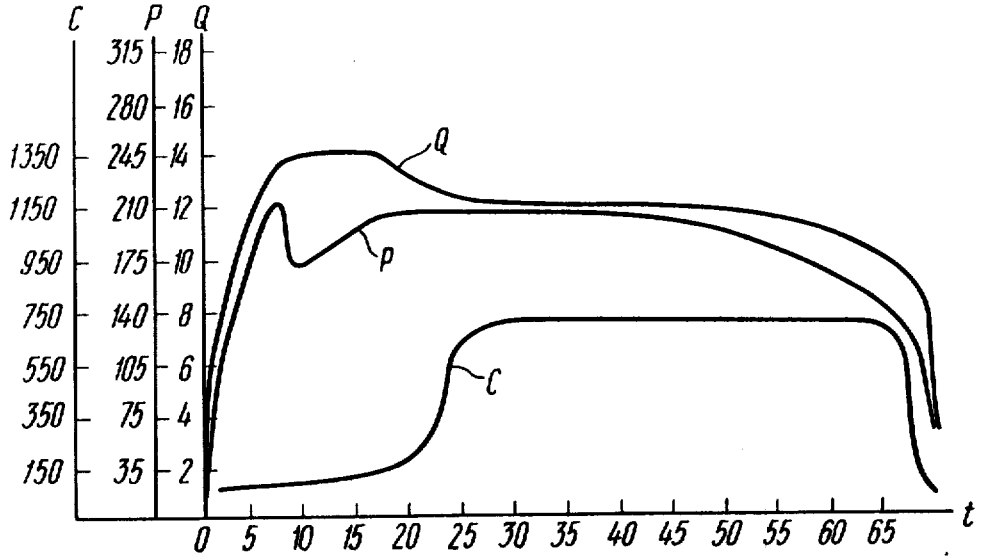

FIG. 3 presents a curve showing the values of the pressure within a formation beyond the casing, built up by the fluid pumped through the nozzles, versus the ratio of the areas of the cross-section of the through passage in the nozzle to the areas of the perforation in the casing wall;

FIG. 4 presents a curve wherein the pressure beyond the casing wall is plotted versus the varying ratio of the cross-sectional areas of the central through passages of the nozzles;

FIG. 5 illustrates an apparatus for hydraulic perforation and hydraulic fracturing in a well;

FIG. 6 shows a well with the apparatus for hydraulic perforation and hydraulic fracturing therein, and a hydraulic fracture formed therein;

FIG. 7 illustrates the apparatus for hydraulic perforation and hydraulic fracturing in the well, positioned for forming a next hydraulic fracture;

FIG. 8 shows schematically the layout of the equipment employed for carrying out the herein disclosed method;

FIG. 9 illustrates pressure, flow rate and sand concentration variations of the fluid used for hydraulic perforation of the casing and hydraulic fracturing of the formation, according to the invention;

The herein disclosed method is realized as follows.

With due regard for the geological characteristics of the formations, the required depths and quantities of hydraulic fractures are predetermined. In the case of a thick stratum, the necessary number of such hydraulic fractures in this formation varies, while in the case of several strata, the required number of such fractures in each formation is specified.

Then, the devices by means of which hydraulic perforation and fracturing of the formation are to be performed, in succession, are prepared for a trip into the cased well. The devices may be, for example, in the form of an apparatus for treating a productive formation, which is claimed in our co-pending application (U.S. Pat. application No. 670,347 filed Mar. 23, 1976). An essential feature of the apparatus to be used is that the nozzles should be made of a material resistant to abrasion wear, since the abrasive-laden fluid is going to be pumped through these nozzles.

The minimum permissible specific gravity of the abrasive-laden fluid to be used for perforating and hydraulic fracturing, is determined to ensure safe opening out of the formation, from the following expression:

$$\gamma = \frac{\alpha P'}{H} \quad 1.$$

where $\gamma$ is the specific gravity of the abrasive-laden fluid, kg/cm³;

P' is the formation pressure, kg/cm²;

$\alpha$ is the factor of the hydrostatic pressure surpassing the one in the formation. The value of $\alpha$ is selected, depending on H:

with $H < 1200$ m, $\alpha = 1.15$ to $1.20$,
with $H > 1200$ m, $\alpha = 1.05$ to $1.10$;

H is the depth of the selected area for forming a hydraulic fracture.

According to a prespecified fluid flow rate, which is to be maintained during hydraulic fracturing, the nozzles are selected to correspond to this flow rate, the diameter of their central through passage being determined from the following expression:

$$d = \sqrt{\frac{Q}{2 \cdot 355\Phi \sqrt{\frac{1}{\gamma} 2g\Delta P_{1-3}}}}, \quad 2.$$

where $d$ is the diameter of the central through passage of the nozzle, cm,

Q is the fluid flow rate, which is to be maintained during hydraulic fracturing, cm³/sec, $\phi$ is the dimensionless factor of the fluid flow rate;

$\gamma$ is the specific gravity of the fluid with the specified concentration of sand in the flow, kg/cm³;

$g$ is the gravity acceleration, cm/sec²;

$\Delta P_{1-3}$ is the pressure drop across the nozzle, kg/cm², equal to the difference between the pressures at the inlet and outlet of the nozzle.

Stand tests show that the pressure built up beyond the casing during hydraulic perforation depends on a number of factors including the pressure drop across the nozzle, i.e. the pressure differential at the inlet and outlet of the nozzle, as well as the cross-sectional area of the perforation in the casing wall.

During hydraulic perforation in accordance with the herein disclosed method, the perforation can be made to a predetermined diameter. Therefore, the factors influencing the value of the pressure maximally attainable beyond the casing can be selected or varied by using the nozzles of the appropriate hydraulic ratings and by varying the pressure drop across the nozzles.

Meeting the demand that the diameters of the perforations in the casing wall shall equal the diameters of the through passages of the nozzles is essential for practically the entire kinetic energy of the jet of the fluid pumped through the nozzles is to be used for developing a dynamic head within the formation and thus for the hydraulic fracturing pressure.

The value of said pressure is directly related to the ratio of the cross-sectional area of the through passage of the nozzles through which the abrasive-laden fluid is pumped to the cross-sectional area of the perforation in the casing wall.

We have studied the following relationship between the pressure in the formation beyond the casing, built up by the abrasive-laden fluid pumped through the nozzles, and the cross-sectional areas of the through passage of the nozzle and of the perforation in the casing wall, and the pressure drop across the nozzle:

$$P = P_H - \Delta P_{1-3}\Phi_1^2 \frac{f_1^2}{f_3^2}\left[\Phi_3^2 + 2\left(\frac{f_3}{f_1}\Phi_2 - 1\right)\right], \quad 3.$$

where

P is the pressure in the perforation passage, required for forming a hydraulic fracture fissure, kg/cm²;

$P_H$ is the hydrostatic pressure in the casing at the depth of forming the hydraulic perforation fissure, kg/cm²;

$\Delta P_{1-3}$ is the pressure drop across the nozzle, kg/cm², equal to $P_1 - P_3$, where $P_1$ is the pressure at the inlet of the nozzle and $P_3$ is the pressure at the outlet thereof;

$f_1$ is the cross-sectional area I-I (FIG. 1) of the through passage in the nozzle, cm³;

$f_3$ is the cross-sectional area III-III of the perforation in the casing wall, cm²;

$\phi_1$; $\phi_2$; $\phi_3$ are dimension less velocity coefficients depending on the hydraulic ratings or characteristics of the nozzles and can be readily determined by known techniques (see E. Ya. Sokolov, N. M. Singer, "Jet Apparatus", Moscow, "Energiya" P.H., 1970, p. 166).

In the present disclosure the hydraulic ratings of the nozzles are expressed as the relationship between the pressure built up beyond the casing at predetermined parameters of the process and the variation of the diameters of the through passages of the nozzles. In the presently preferred embodiment of the claimed invention, the values of the dimensionless coefficients may be equal to, for example, 0.97; 0.95 or 0.90.

Figure 1:
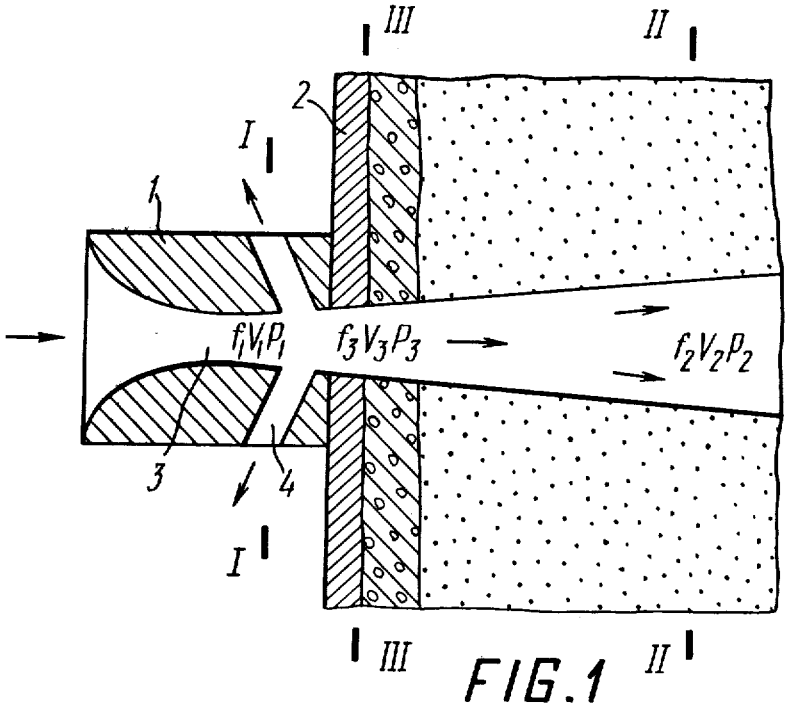
FIG. 1 shows schematically a nozzle pressed against the casing, for hydraulic fracturing.

FIG. 1 of the appended drawings shows schematically a nozzle 1 in its operational position. i.e. pressed against the casing 2.

In the process of hydraulic perforation, the jet formed in the central through passage 3 with cross-sectional area $f_1$ (section I—I) acquires velocity $V_1$, pressure $P_1$ and erodes the wall of the casing 2 over area $f_3$ (the section III-III) at velocity $V_3$ and pressure $P_3$. Then, the spent fluid exits via the outflow passages 4. On the casing 2, perforations of a predetermined diameter, with cross-sectional or flow area $f_3$ are made. The jet then penetrates into the formation and loses its velocity. As a result of this loss of velocity, the pressure in the perforation passage increases, which results in hydraulic fracturing of the formation. The cross-sectional area II—II corresponds to pressure $P_2$ at velocity $V_2$ practically equal to zero, which means that the entire kinetic energy of the jet is utilized for building up this pressure $P_2$.

As a criterion of the optimal hydraulic ratings of the nozzle we consider the ability to attain the maximum possible pressure beyond the casing at a predetermined pressure drop across the nozzle, the value of this attainable pressure being proportional to the ratio of the two dimensions $f_1$ and $f_3$ of the nozzle and being independent of the cross-sectional areas of the outflow passages.

In presenting the above formulae, we make the following assumptions:

- the perforation is of a cylindrical shape, its cross-sectional area equalling that of the through central passage of the nozzle at the area of its contact with the casing wall:
- the factor of non-uniformity of the flow velocities across sections $f_1$ and $f_3$ is taken equal to 1.0.

Figure 2:
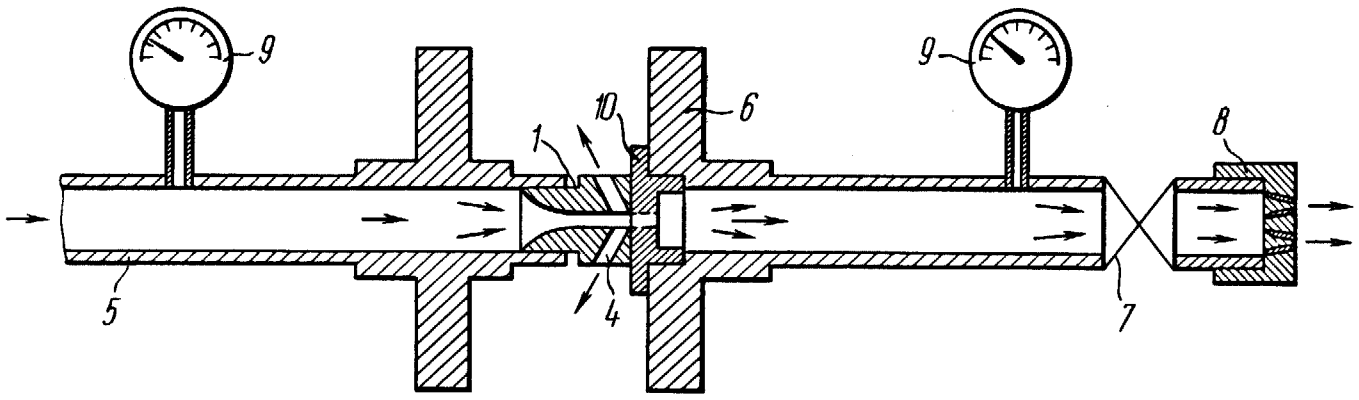
FIG. 2 illustrates a testing facility used for testing the hydraulic characteristics of the nozzles.

To test the practicability of the above calculation formulae for design purposes, a number of experimental tests were performed on the test stand schematically illustrated in FIG. 2.

The fluid was pumped from a pumping unit (not shown) via a conduit 5 to the nozzle 1 under testing and was drained via another conduit 6.

A gate valve 7 was mounted at the outlet of the conduit 6 to adjust the pressure inside the test stand. When an abrasive-laden fluid was used, the gate was kept fully open, and a nozzle box 8 was mounted at the outlet of the gate valve 7, in which case the pressure within the test stand was controlled by either varying the diameters of the jet nozzles in the box or by varying the number of the nozzles in this box.

Pressure gauges 9 were connected to the conduits 5 and 6 to measure, respectively, the pressure at the inlet of the nozzle 1 and downstream of a perforated specimen 10. The tests were carried out with nozzles 1 having the ratio $f_1:f_3$ from 0.1:1 to 1:1 and specimens 10 with respective "perforations".

The nozzle 1 and specimen 10 with a specified ratio $f_1:f_3$ were mounted in the test stand, the gate 7 was fully open, and the pumping unit was operated to pump the fluid through the nozzle. Then, the gate valve 7 was gradually closed until the fluid started trickling from the outflow passages 4 of the nozzle 1, at which stage the readings of the pressure gauges 9 were registered, the difference in the readings of the upstream pressure gauges 9 being considered as the pressure drop across the nozzle, while the readings of the dowsntream pressure gauge were considered as the maximally attainable pressure for the given nozzle.

The test results are illustrated in FIG. 3, where the dash line is the theoretically achieved curve and the solid line is the one obtained as a result of the tests. The values of $f_1:f_3$ are plotted on the axis and those of $\Delta P_2:\Delta P_{1-3}$ are plotted on the $y$ axis. The chart suggests that the experimental data are in good agreement with the theoretical or calculation data, i.e. the above expressions can be used for practical purposes.

As it has been mentioned, the above equations are also based on the assumption that the perforation in the casing is of a cylindrical shape, its cross-sectional area equalling that of the central through passage 3 of the nozzle 1 at the contact area with the casing 2.

To test the validity of this assumption, the above test test stand was used to perform hydraulic perforation of a number of specimens with nozzles having different ratios $f_1:f_3$. The tests proved that in each case in the barriers there was made a perforation $f_3$ having a shape and a size identical with those of the central through passage 3 of the nozzle 1 at the area of its contact with the casing. In this way the assumption has been proved valid.

The same test stand was used to determine the pressure which should be created in the perforation passage prior to opening-out of the hydraulic fracture (i.e. while the fluid was still returning in full volume via the outflow passages 4 of the nozzles 1 into the casing). This was done by mounting a nozzle and a specimen with a specified value of $f_1:f_3$ on the test stand, fully closing the gate valve 7 and pumping water through the nozzle 1, gradually stepping up the pumping rate until 300 kg/cm$^2$ pressure was set upstream of the nozzle. Simultaneously, the readings of the downstream pressure gauges 9 were registered, i.e. the pressure value downstream of the specimen 10. The tests were performed with the $f_1:f_3$ ratio ranging from 0.1:1 to 1:1.

The test results are shown in FIG. 4 where plotted on the x axis is the ratio $f_1:f_3$ and plotted on the y axis are the values of the pressure $P_1$ atm. The line A is the pressure upstream of the nozzle, while the curve B shows the relationship between the pressure beyond the casing and the varying ratio of the cross-sectional areas of the central through passage 3 of the nozzle 1.

The chart of FIG. 3 shows that prior to the formation of the hydraulic fracture, a pressure which is created within the perforation passage, considerably exceeds the maximally attainable value of the pressure beyond the casing upon the formation of the hydraulic fracture (when the fluid ceases to flow back via the outflow passages 4 of the nozzles 1 into the casing 2).

Practically, the actual pressure built up within the perforation passage would be even higher (by the value of the pressure loss in the annulus). This is still another advantage of the herein disclosed method, since before the hydraulic fracture is developed, the required pressure more often than not is to be higher than that required after the hydraulic fracture is formed.

The curves in FIG. 3 illustrate that according to the function we have found, with the area of the perforation in the casing 2 increasing, the maximum attainable value of the pressure within the formation decreases, the highest value of the pressure being attained when the ratio of the cross-sectional area $f_1$ of the central flow passage 3 of the nozzle 1 to the area $f_3$ of the perforation in the casing wall equals 0.82, i.e. $f_1:f_3=0.82$.

Therefore, in order to attain the maximum breakdown pressure within the formation, perforations with predetermined cross-sectional areas $f_3=1.22 f_1$ are to be made in the casing. This condition is fulfilled by running into a well 1 the apparatus 12 (FIG. 5) to be used for hydraulic fracturing of the formation 13 and pressing the nozzles 1 through which the abrasive-laden fluid will be pumped, tightly against the casing wall 2. Consequently, perforations are formed in the casing 2 having a diameter equal to that of the outlet end of the nozzle 1. The pressure of the fluid pumped through the nozzles 1 is maintained at a value not less then the pressure required for hydraulic fracturing of the formation, the necessary pressure of the abrasive-laden fluid pumped through the nozzles being determined from the above formula.

This pressure of the fluid pumped through the nozzles is maintained at a constant value not less than the hydraulic fracturing pressure, which is attained by varying the flow rate the abrasive-laden fluid pumped through the nozzles.

Upon the perforations having been made in the casing wall 2, the abrasive-laden fluid enters the formation 13. The pressure of the fluid being pumped brings about hydraulic fracturing of the formation 13, with a hydraulic fracture 14 (FIG. 6) formed.

The moment of the perforation being formed in the casing wall 2 and of commencing of hydraulic fracturing of the formation 13 is accompanied by the fluid ceasing to flow back from the well 11, while throughout the operation of the hydraulic perforation of the casing wall 2 the fluid has been flowing out from the annulus. This feature in combination with the sharp drop of pressure means that the formation has been hydraulically fractured, and the amount of the sand fed into the fluid being pumped into the well is aimed at protecting the fracture formed by hydraulic fracturing from closing when the hydraulic fracturing operation per se is completed. This feature, in combination with a sharp pressure drop, means that the formation has been hydraulically fractured, and the amount of the sand fed into the fluid being pumped into the well is increased.

When the required amount of sand is pumped into the well, the pumping operation is discontinued, and the next hydraulic fracture is made, by placing the apparatus 12 against the area selected for forming of the next fracture 15 (FIG. 7), whereafter the above-described sequence of operations is repeated.

It should be borne in mind that, following the above process, i.e. when fractures are formed hydraulically, the formation can be subjected to various treatment, e.g. hydrochloric acid treatment, with hydrochloric acid being pumped through the same nozzles, or to mud-acid treatment, methanol treatment, etc., with respective fluids being pumped into the formation through these nozzles.

The herein disclosed new method was tested in a production well with a 114 mm casing string.

The well 16 (FIG. 8) was equipped with a well head packing 17, a gate valve 18 on the pressure line, another gate valve 19 specially provided for controlling the pressure in the well during circulation, gate valves 20 and a pressure gauge. The tubes 22 were connected to the pumping units, while the tubes 23 were connected to a sand mixer.

The apparatus which performed the herein disclosed method had three nozzles with the central through passages 6 mm in diameter, with $f_1:f_3 = 0.5$; it was run into the well on a tubing string to a depth of 600 m.

The high-pressure units were connected to the well so that the surface communication means would provided for both forward and reverse circulation of the fluid.

The abrasive-laden fluid was pumped into the formation, the abrasive filler being sand supplied from the sand mixer.

Every parameter of the process was recorded and plotted in the chart shown in FIG. 9.

Plotted on the $x$ axis is time in minutes, while plotted on the multiple y axes are the concentration of sand in the fluid, grams per liter, pressure P in kg/cm² and flow rate Q in liters per second. Thus, the curves Q, P and C of the chart show, respectively, the variation of the flow rate, pressure and sand concentration in the fluid versus time.

After 7 minutes the pressure P changed from 210 to 170 kg/cm² with a constant flow rate Q = 14 1/sec, and, simultaneously, the amount of the fluid flowing back from the well considerably decreased. This was an indication that perforations were formed in the casing wall, and that hydraulic fracturing had started. After the fractures have been formed, the flow rate of the fluid was changed to maintain a constant pressure within the formation. At the same time, the concentration of sand in the fluid pumped into the well was increased to 740 grams per liter. In this way 19 tons of sand were pumped into the fractured formation.

The fractures being packed with sand, the apparatus was lifted to the level of the next upper stratum, and the entire sequence of operations was repeated. In this manner, there were formed 11 fractures on one well, in a single trip of the apparatus into the well.

What is claimed is:

1. A method of successively opening-out and treating gas and oil bearing formations by forming hydraulic fractures therein with abrasive-laden fluid, comprising the steps of pressing jet nozzles tightly to a casing wall opposite the area where a hydraulic fracture is to be formed, the nozzles having a diameter of their through passage, which ensures that at a constant flow rate of the abrasive-laden fluid pumped through the nozzles there is maintained a pressure sufficient for hydraulic fracturing of the formation; pumping said abrasive-laden fluid at said flow rate through said nozzles at a pressure sufficient for making perforations through said casing wall, but not less than the pressure of hydraulic fracturing of the formation, until perforations are made in said casing wall of diameters substantially equal to those of said through passages of said nozzles; upon said perforations having been made, varying the flow rate of said abrasive-laden fluid pumped through said nozzles, to build up a substantially constant pressure within said formation, not less than the pressure of hydraulic fracturing of said productive formation.

* * * * *